US005507663A

United States Patent [19]

Beckmann

[11] Patent Number: 5,507,663

[45] Date of Patent: Apr. 16, 1996

[54] MULTICONTACT PLUG ASSEMBLY WITH ADAPTER

[75] Inventor: Wolfgang Beckmann, Kirchhundem, Germany

[73] Assignee: Mennekes Elektrotechnik GmbH & Co. KG, Kirchhundem, Germany

[21] Appl. No.: 375,152

[22] Filed: Jan. 18, 1995

[30] Foreign Application Priority Data

Jan. 26, 1994 [DE] Germany ..... 44 02 174.7

[51] Int. Cl.[6] ..... H01R 13/627

[52] U.S. Cl. ..... 439/357

[58] Field of Search ..... 439/350, 357, 439/299, 300, 553, 345

[56] References Cited

FOREIGN PATENT DOCUMENTS 2948843 6/1981 Germany .

*Primary Examiner*—Gary F. Paumen
*Attorney, Agent, or Firm*—Herbert Dubno; Andrew Wilford

[57] ABSTRACT

The socket has a housing, an outer sleeve on the housing centered on an axis and having an axially extending and radially inwardly open groove. A latching element in the housing in axial alignment with the groove is displaceable axially relative to the outer sleeve. A spring or other biasing unit is braced between the latching element and the housing for urging the latching element into an outer position and a mechanical coupling between the latching element and the switch prevents a switch on the housing the switch from moving from its the position to its on position except when the element is in an inner position. A nonmatching plug has a body formed with a radially outwardly open recess and respective contacts in the body are engageable with contacts of the outer sleeve. A tubular adapter body is fittable over the plug body and inside the outer sleeve in an inserted position with the plug contacts engaging the socket contacts. A radially outwardly projecting bump on the tubular body engages the latch element to hold the latching element in the inner position in the inserted position, and a retaining element on the outer sleeve projects radially inward into the recess of the plug body and bears radially outward against the outer sleeve only in the inserted position so that in the inserted position the bump holds the latching element in the inner position and the retaining element locks the adapter and plug in the outer sleeve.

12 Claims, 5 Drawing Sheets

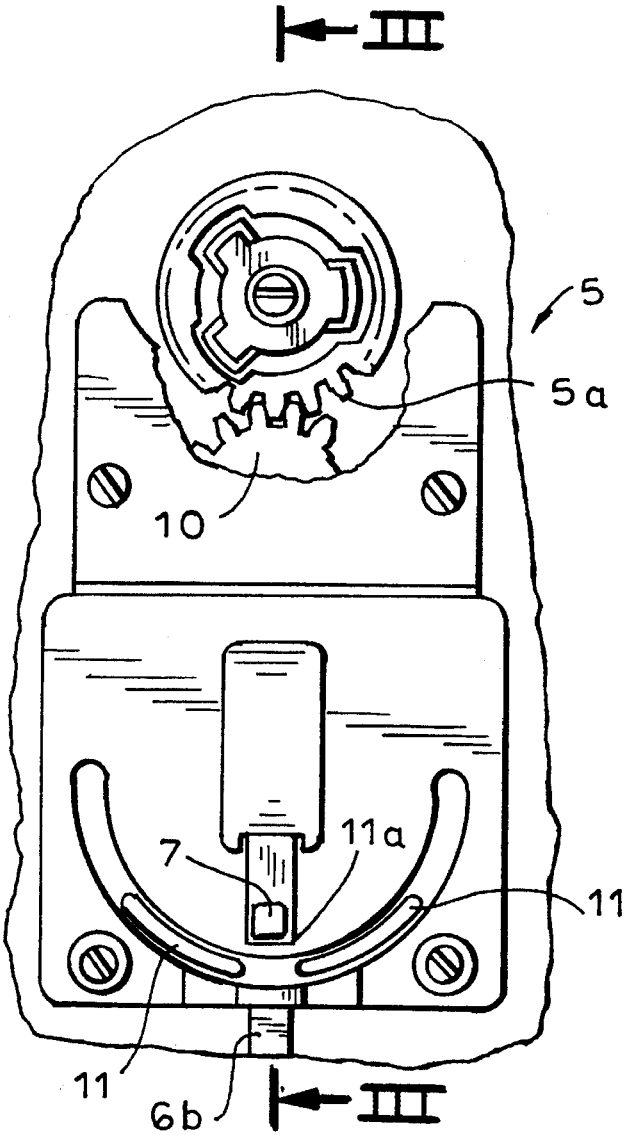
FIG. 2
FIG. 3
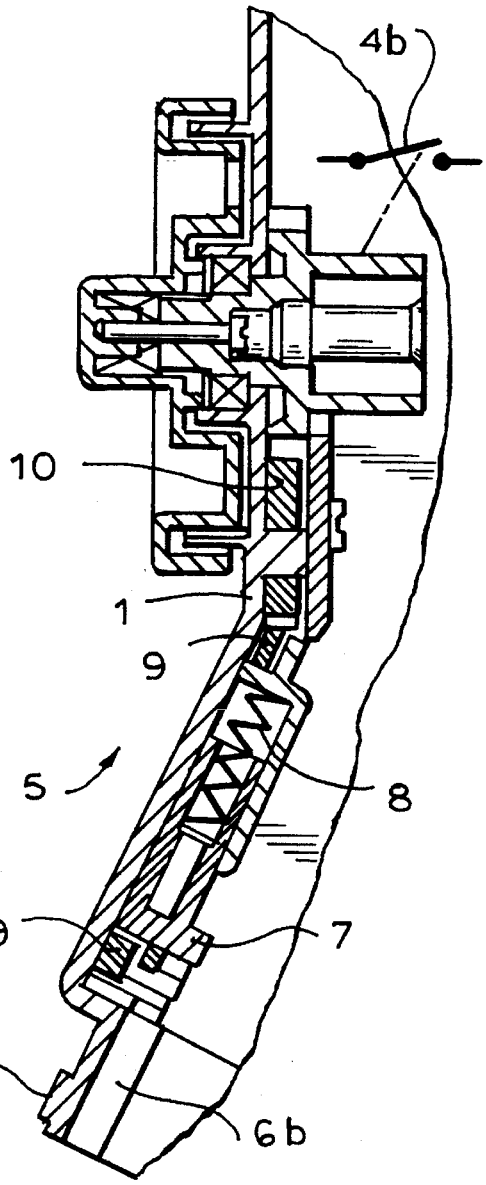

MULTICONTACT PLUG ASSEMBLY WITH ADAPTER

SPECIFICATION

FIELD OF THE INVENTION

The present invention relates to a multicontact plug assembly. More particularly this invention concerns a plug and socket capable of interconnecting a plurality of electrical conductors.

BACKGROUND OF THE INVENTION

A plug assembly is known that has a socket having a housing, an outer sleeve on the housing of a predetermined inner diameter, centered on an axis, and having an axially extending and radially inwardly open groove, and a plurality of contacts mounted in the outer sleeve. A switch on the housing is movable between an on position and an off position and a latching element in the housing in axial alignment with the groove is displaceable axially relative to the outer sleeve between inner and outer positions. A spring or other biasing means is braced between the element and the housing for urging the element into the outer position and a coupling between the latching element and the switch prevents the switch from moving from the off position to the on position except when the element is in the inner position. A plug has a body with an outer diameter generally equal to the inner diameter of the outer sleeve. Respective contacts in the plug body are engageable with the contacts of the outer sleeve so that when the plug body is fitted inside the outer sleeve the plug contacts engage the socket contacts. A radially outwardly projecting bump on the second-plug body engages the latch element to hold same in the inner position in the inserted position. Such a system with electrical decoupling is described in German patent document 2,948,843.

Thus only when the plug is inserted fully into the socket can the switch be moved to the on position. In a variant on the system a latch is provided for locking the plug in the socket when the switch is in the on position so that the socket terminals cannot therefore be left hot and unexposed, and the danger of arcing on disconnect is completely eliminated. Thus this arrangement is quite safe. In addition the position of the alignment bump and the array of the contacts can ensure that plugs and sockets are matched perfectly, making misconnections virtually impossible.

The main problem is that a piece of equipment having the state-of-the-art matched sockets is frequently used with older add-ons whose plugs do not match. Thus it is necessary to replace the cables at least of the auxiliary equipment.

OBJECTS OF THE INVENTION

It is therefore an object of the present invention to provide an improved plug/socket assembly.

Another object is the provision of such an improved improved plug/socket assembly which overcomes the above-given disadvantages, that is which ensures a proper match between plug and socket but which permits of use of nonmatched plugs in some instances.

SUMMARY OF THE INVENTION

The socket according to the invention has a housing, an outer sleeve on the housing of a predetermined inner diameter, centered on an axis, and having an axially extending and radially inwardly open groove, and a plurality of contacts mounted in the outer sleeve. A switch on the housing is movable between an on position and an off position and a latching element in the housing in axial alignment with the groove is displaceable axially relative to the outer sleeve between inner and outer positions. A spring or other biasing unit is braced between the element and the housing for urging the element into the outer position and a mechanical coupling between the latching element and the switch prevents the switch from moving from the off position to the on position except when the element is in the inner position. Here a nonmatching plug has a body formed with a radially outwardly open recess and having an outer diameter substantially less than the inner diameter of the outer sleeve. Respective contacts in the body are engageable with the contacts of the outer sleeve. According to the invention an adapter has a tubular body of an outer diameter generally equal to the inner diameter of the outer sleeve and an inner diameter generally equal to the outer diameter of the plug body. The adapter body is fittable over the plug body and inside the outer sleeve in an inserted position with the plug contacts engaging the socket contacts. A radially outwardly projecting bump on the tubular body engages the latch element to hold same in the inner position in the inserted position, and a retaining element on the outer sleeve projects radially inward into the recess of the plug body and bears radially outward against the outer sleeve only in the inserted position so that in the inserted position the bump holds the element in the inner position and the retaining element locks the adapter and plug in the outer sleeve.

Thus the adapter according to this invention not only makes it possible for a nonmatching plug to be used with the fitted socket, but also imparts to the nonmatching plug the safety features of a matching plug. Thus a standard plug can be used in an environment where explosion is a danger. In general the system of this invention allows equipment to be upgraded piecemeal, without having to buy all new sensors and the like. The adapter can even be permanently mounted on a nonmatching plug to conform it to new equipment.

According to the invention the system remains usable, without the adapter, with a second plug separate from the first-mentioned plug and having a body formed with a radially outwardly open recess and having an outer diameter generally equal to the inner diameter of the outer sleeve. Respective contacts in the second-plug body are engageable with the contacts of the outer sleeve. The second-plug body is fittable inside the outer sleeve in a respective inserted position with the second-plug contacts engaging the socket contacts and a radially outwardly projecting bump on the second-plug body is engageable with the latch element to hold same in the inner position in the inserted position.

In accordance with a further feature of the invention a locking element is displaceable in the housing between a locking position axially outward of the bump in the inserted position to prevent axial outward movement of the bump in the locking position and a freeing position spaced therefrom and permitting axial outward movement of the bump. Locking means between the locking element and the switch move the locking element into the locked position on displacement of the switch into the on position. Thus either a matching plug or a nonmatching plug and adapter are locked in the socket when the switch is turned on, and of course the switch can only be turned on when the plug is inserted.

The adapter body according to the invention is nonrotatable in the outer sleeve about the axis and is axially limitedly movable in the housing between the inserted position and an uninserted position spaced axially outward in the housing from the inserted position and out of contact with the latching element. The plug body and adapter body are formed with an axially extending and radially interfitting ridge and groove.

The recess in accordance with the invention is an axially extending and radially outwardly open notch having an inclined inner end so that as the plug and adapter are inserted axially inward into the outer sleeve the inclined inner end cams the retaining element inward into the recess. The retaining element is biased radially outward and the recess is a radially outwardly open annular groove. Normally the retaining element is an axially projecting finger on the sleeve which may be made of steel or plastic and unitarily formed with the sleeve.

The socket of this invention further has according to the invention an inner sleeve coaxially received in the inner sleeve and holding the socket contacts. The inner sleeve is formed with a radially outwardly projecting annular rim and the housing has a seat receiving the rim and permitting at least limited rotation of the inner sleeve about the axis. Interengaging retaining formations on the rim and housing substantially preventing rotation of the inner sleeve in the housing. Thus the angular position of the socket contacts can be adjusted at the socket, making it possible to use a standardized socket and set it for different plugs.

BRIEF DESCRIPTION OF THE DRAWING

The above and other objects, features, and advantages will become more readily apparent from the following description, reference being made to the accompanying drawing in which:

FIG. 2 is a bottom view of a detail of the assembly;

FIG. 3 is a section taken along line III—III of FIG. 2;

SPECIFIC DESCRIPTION

Figure 1:
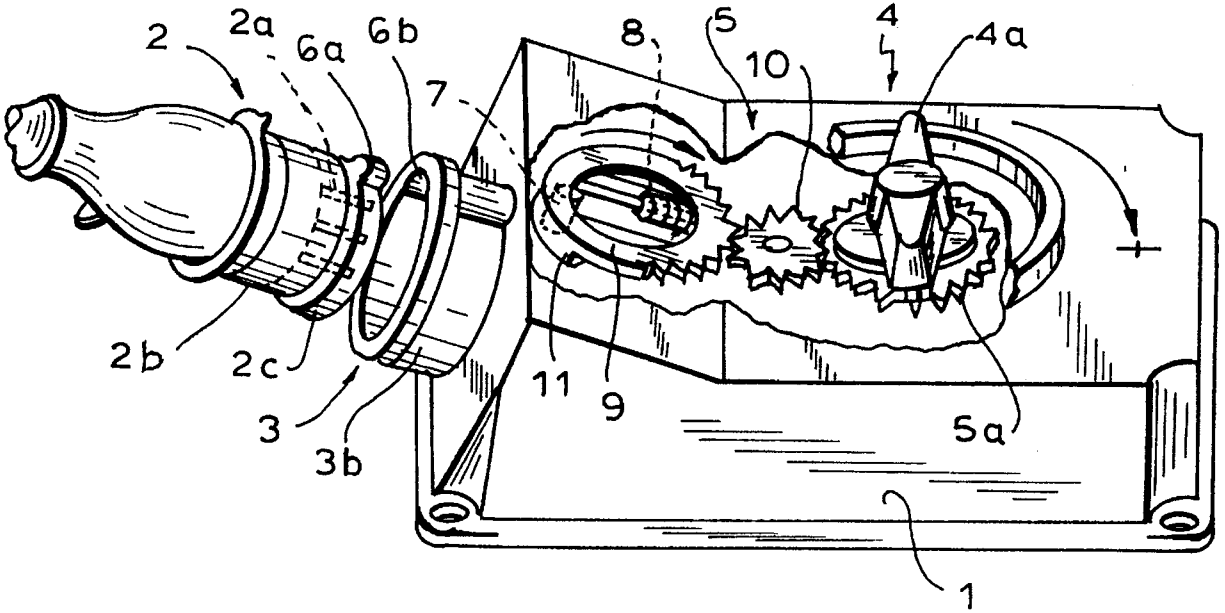
FIG. 1 is a partly broken-away perspective view of the assembly of this invention.
Figure 4:
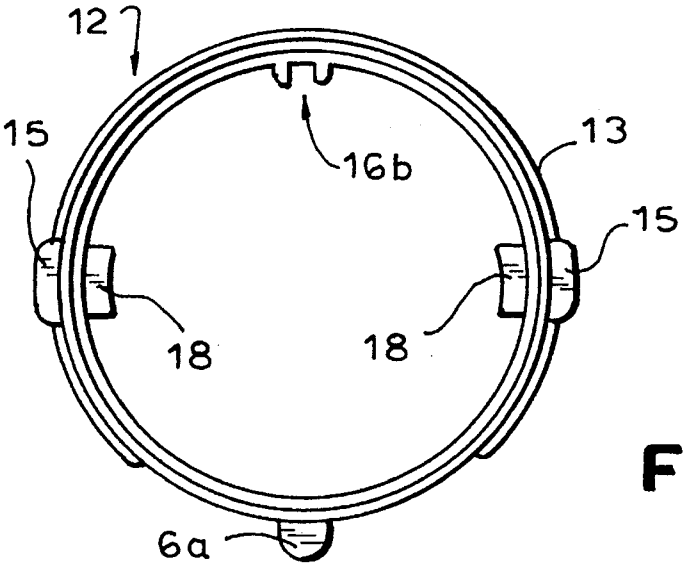
FIG. 4 is an end view of an adapter for the assembly.

As seen in FIGS. 1 through 3 a plug assembly according to the invention is basically comprised of a plug 2 and socket 3 both centered on an axis A and a switch unit 4 connected to the plug 5 via a release/latch mechanism 5. The socket 2, switch unit 4, and mechanism 5 are carried in a common housing 1. The assembly is constructed so that the plug 2 can only be inserted into or withdrawn from the socket 3 when the socket is deenergized.

Figure 6:
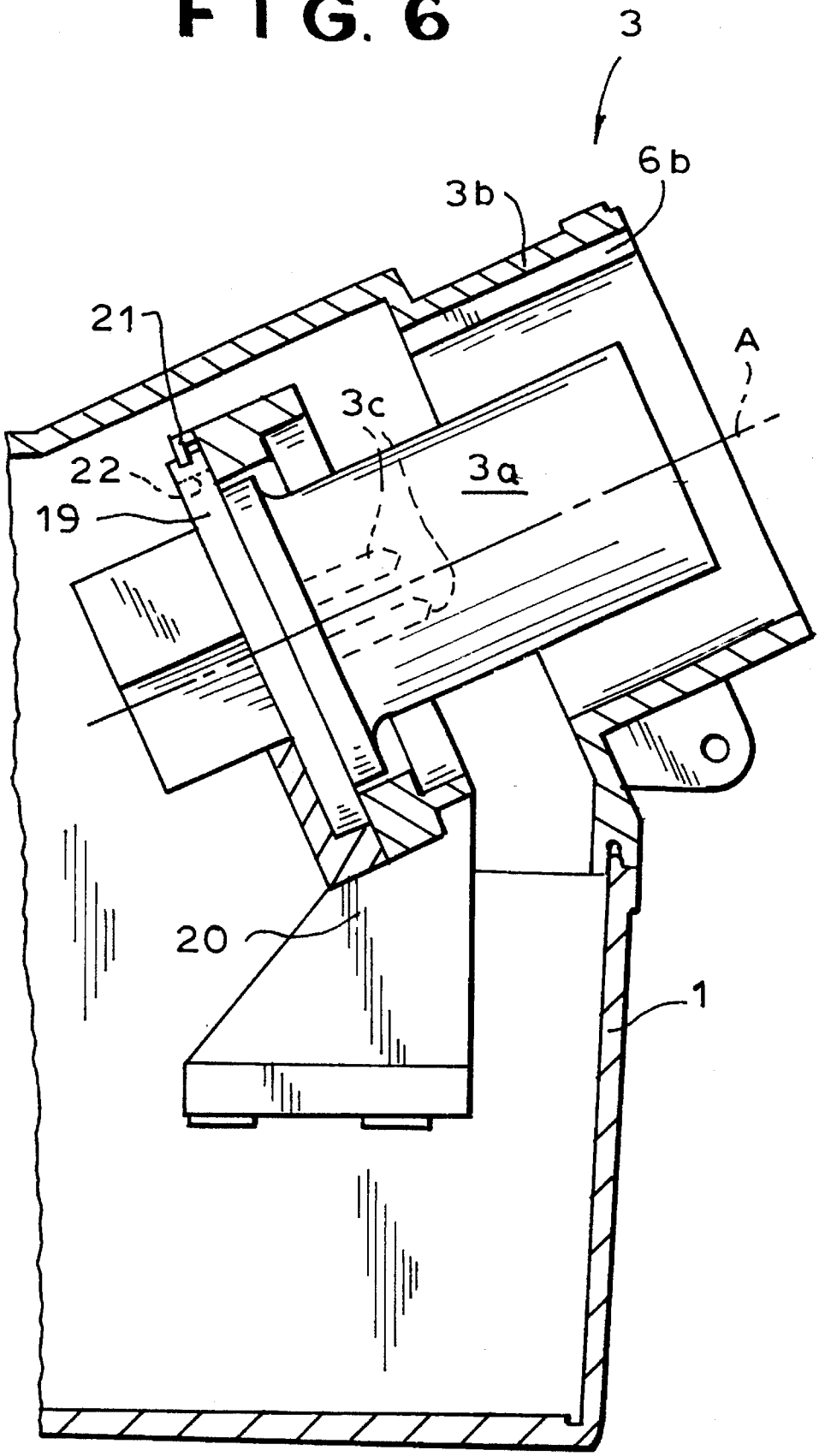
FIG. 6 is a large-scale axial section through a detail of the assembly.

The plug 2 has a plurality of contact pins 2*a* extending parallel to the axis A and a basically cylindrical body 2*b* provided at its forward end with an annular ridge 2*c* formed with a radially outwardly projecting bump 6*a* constituting an alignment and latching formation. The socket 3 has an inner sleeve 3*a* (see FIG. 6) provided internally with contact sleeves 3*c* into which the pins 2*a* can fit and dimensioned to fit inside the tubular body 2*b* of the plug 2. In addition the socket 3 has a fixed outer sleeve 3*b* formed internally with a radially inwardly open and axially extending groove 6*b* complementary to the bump 6*a* so that the plug body 2*b* can fit into the outer sleeve 3*b* with the bump 6*a* sliding axially inward along the groove 6*b*. As seen in FIG. 6 the inner sleeve 3*a* is formed with a rim 19 rotatable about the axis A in a holder 20 of the housing 1. A finger 21 engaging in a notch 22 of the rim 19 rotationally arrests it.

The switch unit 4 has a manually actuated knob 4*a* that can operate a switch shown schematically at 4*b* in FIG. 3 by rotation through angularly offset positions. The mechanism 5 includes a gear 10 in the housing 1 meshing on one side with a gear 5*a* rotationally fixed on the shaft of the knob 4*a* and on the other side with a wheel 9 rotatable about an axis perpendicular to the axis A.

The housing 1 carries a latch element 7 movable parallel to the axis A and having an end that is exposed inside the outer sleeve 3*b* in line with the groove 6*b*. A spring 8 urges the element 7 axially outward so that when a plug 2 is fitted into the socket 3 the bump 6*a* will engage the element 7 and push it axially inward, to the right in FIG. 1, against the force of the spring 8. The wheel 9 is formed with an unillustrated notch into which the element 7 fits when it is in its axial outer position shown in FIG. 2, thereby locking the wheel 9 against rotation. Of course, if the wheel 9 cannot rotate, neither can the gears 10 or 5*a* so that the switch 4 is locked. In addition the wheel 9 carries a pair of retaining formations 11 (FIG. 2) shaped as circular segments and defining a gap 11*a* that is aligned between the groove 6*b* and the element 7 in the closed position of the switch unit 4. When the switch 4 is closed, which can only take place when the bump 6*a* is pushing the element 7 inward, the retaining segments 11 will move into position between the element 7 and the groove 6*b* to make it impossible to pull the plug 2 out of the socket 3. Thus the plug 2 can only move into or out of the socket 3 when the power is off, and the power can only be turned on when the plug 2 is fully inserted into the socket 3.

FIGS. 4 and 5*a–c* show how a plug 2' that is of smaller diameter than the plug 2 and that is not provided with the collar 2*c* and bump 6*a*, can be used with the socket 3 when a special plastic adapter tube 12 having the formation 6*a* is employed. The plug 2' has a cylindrical body formed with a longitudinal and axial groove 16*a* into which can fit a ridge formation 16*b* formed on the cylindrical inner wall of the tube 12. In addition the plug 2' has a circumferential and radially outwardly open groove 14 into which can fit elbow parts of deflectable spring fingers 15 formed unitarily on the tube 12. These fingers 15 could also be separate spring-steel elements imbedded in a plastic sleeve or integrally formed with a steel sleeve. The end of the tube 12 has radially inwardly projecting tabs 18 against which the end of the plug 2' engages. The outer sleeve 2*b* of the socket 2 is formed with radially inwardly open and axially extending grooves 17*a* having outer ramps 17*b* that fit with and guide the fingers 15. In addition the tube 12 is formed with a radially outwardly projecting stop ridge 13 so that this tube 12 can move limitedly axially in the sleeve 3*b*.

Figure 5B:
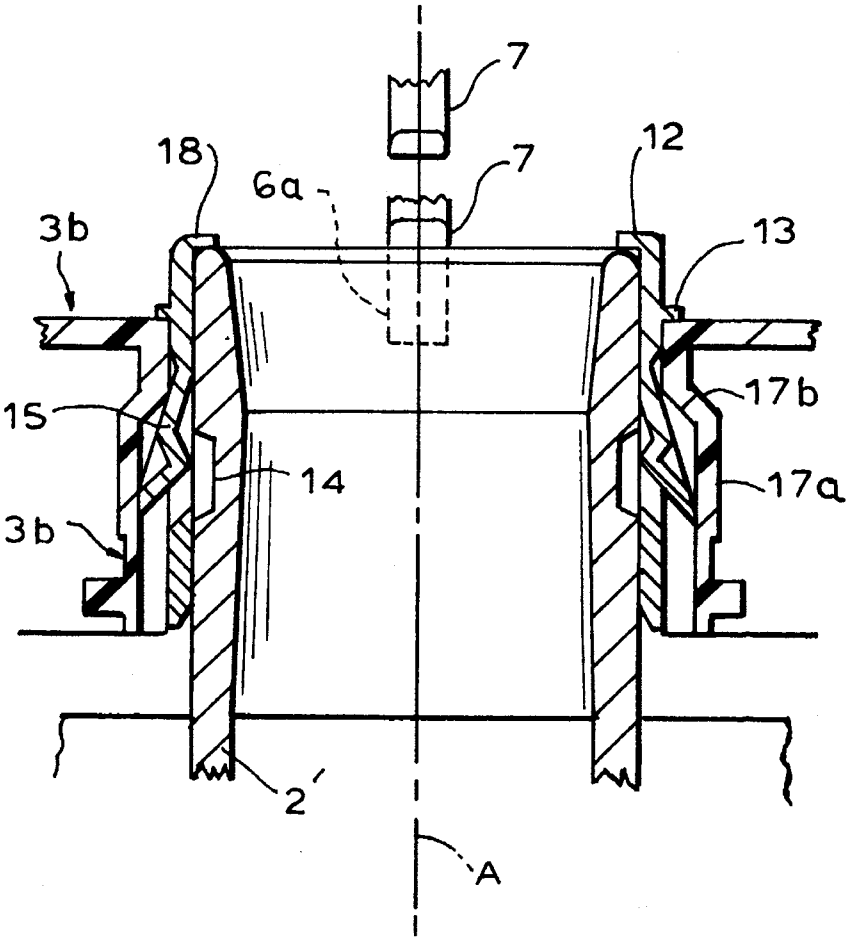
FIG. 5*a*, 5*b*, and 5*c* are axial sections through an assembly using the FIG. 4 adapter.
Figure 5A:
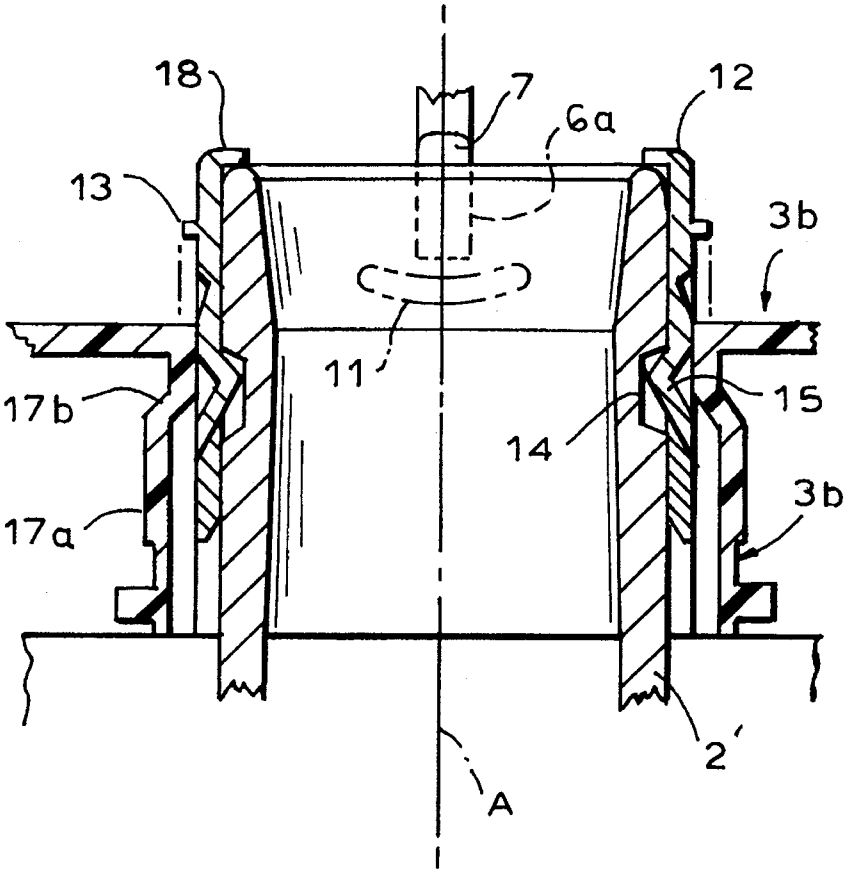

When the nonstandard plug 2' is inserted as shown in FIG. 5*a* all the way into the adapter 12 in the socket 3 its end will engage the tabs 18 to push the adapter 12 all the way in so that the bump 6*a* pushes in the element 7 and the retaining formations 11 can lock this bump 6*a* in place. At the same time the sleeve 3*b* will cam the fingers 16 in to engage in the groove 14 and lock the plug 2' axially to the adapter 12, since the inner diameter of the sleeve 3*b* inward of the grooves 17*a* is equal to the outer diameter of the adapter 12. In this position the plug 2' and adapter 12 are axially locked in the housing 1, and in fact a supplemental latch 23 (FIG. 5*c*) engageable over the ridge 13 may be employed to further hold them in place.

To retract the plug 2' the switch unit 4 will have to be turned off to move the formations 11 out of the way, and the plug 2' is moved axially out as shown in FIG. 5*b*. To start with the adapter tube 12 moves with the plug 2' until the abutment ridge 13 lies on the inner face of the housing 1 and the fingers 15 are aligned with the pockets 17*a* and can spring outward from their own natural resiliency. The adapter 12 is unable to move axially further out from this position.

Figure 5C:
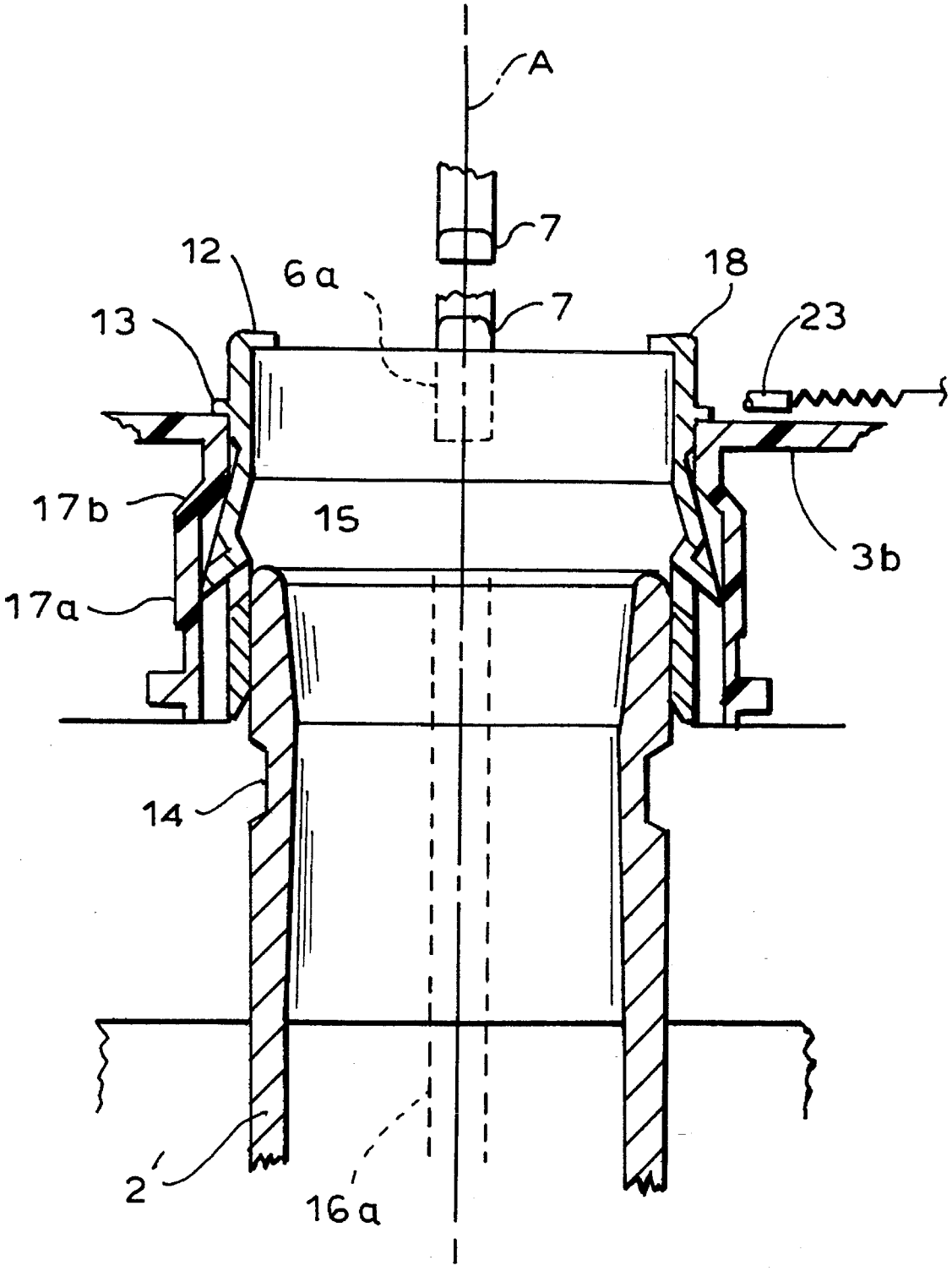

Subsequently as shown in FIG. 5*c*, the nonstandard plug 2' can be pulled completely out of the adapter 12. This leaves the adapter 12 in the illustrated outer position, ready to receive the same or another such nonstandard plug 2'.

I claim:

1. In combination:

a socket having a housing, an outer sleeve on the housing, of a predetermined inner diameter, centered on an axis, and having an axially extending and radially inwardly open groove, a plurality of contacts mounted in the outer sleeve, a switch on the housing movable between an on position and an off position, a latching element in the housing in axial alignment with the groove and displaceable axially relative to the outer sleeve between inner and outer positions, biasing means braced between the element and the housing for urging the element into the outer position, and coupling means between the latching element and the switch for preventing the switch from moving from the off position to the on position except when the element is in the inner position;

a first plug having a body formed with a radially outwardly open recess and having an outer diameter substantially less than the inner diameter of the outer sleeve, and respective contacts in the body engageable with the contacts of the outer sleeve; and an adapter having a tubular body of an outer diameter generally equal to the inner diameter of the outer sleeve and an inner diameter generally equal to the outer diameter of the plug body, the adapter body being fittable over the plug body and inside the outer sleeve in an inserted position with the plug contacts engaging the socket contacts, a radially outwardly projecting bump on the tubular body engageable with the latching element to hold the latching element in the inner position in the inserted position, and a retaining element on the outer sleeve projecting radially inward into the recess of the plug body and bearing radially outward against the outer sleeve only in the inserted position, whereby in the inserted position the bump holds the latching element in the inner position and the retaining element locks the adapter and plug in the outer sleeve;

a second plug separate from the first plug and having a body formed with a radially outwardly open recess and having an outer diameter generally equal to the inner diameter of the outer sleeve, and respective contacts in the second-plug body engageable with the contacts of the outer sleeve, the second-plug body being fittable inside the outer sleeve in a respective inserted position with the second-plug contacts engaging the socket contacts, a radially outwardly projecting bump on the second-plug body engageable with the latching element to hold the latching element in the inner position in the respective inserted position.

2. The combination defined in claim 1, further comprising a locking element displaceable in the housing between a locking position axially outward of the bump in the inserted position of the respective plug to prevent axial outward movement of the bump in the locking position and a freeing position spaced therefrom and permitting axial outward movement of the bump; and locking means between the locking element and the switch for moving the locking element into the locked position on displacement of the switch into the on position.

3. The combination defined in claim 1 wherein the adapter body is nonrotatable in the outer sleeve about the axis and axially limitedly movable in the housing between the inserted position and an uninserted position spaced axially outward in the housing from the inserted position and out of contact with the latching element.

4. The combination defined in claim 1 wherein the plug bodies and the adapter body are each formed with an axially extending and radially interfitting ridge and groove.

5. The combination defined in claim 1 wherein the recesses are each an axially extending and radially outwardly open notch having an inclined inner end, whereby as the first plug and adapter are inserted axially inward into the outer sleeve the inclined inner end cams the retaining element inward into the recess.

6. The combination defined in claim 1 wherein the retaining element is biased radially outward.

7. The combination defined in claim 1 wherein each recess is a radially outwardly open annular groove.

8. The combination defined in claim 1 wherein the retaining element is an axially projecting finger on the sleeve.

9. The combination defined in claim 8 wherein the finger is unitarily formed with the sleeve.

10. The combination defined in claim 1, further comprising an inner sleeve coaxially received in the inner sleeve and holding the socket contacts, the inner sleeve being formed with a radially outwardly projecting annular rim, the housing having a seat receiving the rim and permitting at least limited rotation of the inner sleeve about the axis.

11. The combination defined in claim 10, further comprising interengaging retaining formations on the rim and housing substantially preventing rotation of the inner sleeve in the housing.

12. In combination:

a socket having a housing, an outer sleeve on the housing, of a predetermined inner diameter, centered on an axis, and having an axially extending and radially inwardly open groove, a plurality of contacts mounted in the outer sleeve, a switch on the housing movable between an on position and an off position, a latching element in the housing in axial alignment with the groove and displaceable axially relative to the outer sleeve between inner and outer positions, biasing means braced between the element and the housing for urging the element into the outer position, and coupling means between the latching element and the switch for preventing the switch from moving from the off position to the on position except when the element is in the inner position;

a plug having a body formed with a radially outwardly open recess and having an outer diameter substantially less than the inner diameter of the outer sleeve, and respective contacts in the body engageable with the contacts of the outer sleeve; and an adapter having a tubular body of an outer diameter generally equal to the inner diameter of the outer sleeve and an inner diameter generally equal to the outer diameter of the plug body, the adapter body being fittable over the plug body and inside the outer sleeve in an inserted position with the plug contacts engaging the socket contacts, a radially outwardly projecting bump on the tubular body engageable with the latching element to hold the latching element in the inner position in the inserted position, and a retaining element on the outer sleeve projecting radially inward into the recess of the plug body and bearing radially outward against the outer sleeve only in the inserted position, whereby in the inserted position the bump holds the latching element in the inner position and the retaining element locks the adapter and plug in the outer sleeve.

* * * * *